US011423859B2

(12) United States Patent
Wang

(10) Patent No.: US 11,423,859 B2
(45) Date of Patent: Aug. 23, 2022

(54) DISPLAY CONTROL APPARATUS AND DISPLAY DEVICE

(71) Applicant: HKC Corporation Limited, Shenzhen (CN)

(72) Inventor: Mingliang Wang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 2 days.

(21) Appl. No.: 17/043,530

(22) PCT Filed: Nov. 28, 2018

(86) PCT No.: PCT/CN2018/118006
§ 371 (c)(1),
(2) Date: Sep. 29, 2020

(87) PCT Pub. No.: WO2020/097987
PCT Pub. Date: May 22, 2020

(65) Prior Publication Data

US 2021/0110784 A1 Apr. 15, 2021

(30) Foreign Application Priority Data

Nov. 12, 2018 (CN) ..... 201811338831.4

(51) Int. Cl.
*G09G 3/36* (2006.01)

(52) U.S. Cl.
CPC ..... *G09G 3/3688* (2013.01); *G09G 3/3677* (2013.01); *G09G 2310/08* (2013.01)

(58) Field of Classification Search
CPC .. G09G 3/3614; G09G 3/3659; G09G 3/3674; G09G 3/3685; G09G 3/2942;
(Continued)

(56) References Cited

U.S. PATENT DOCUMENTS

2005/0052382 A1* 3/2005 Lin ..... G09G 3/3659 345/87
2005/0127998 A1* 6/2005 Maekawa ..... H03F 3/45237 330/253

(Continued)

FOREIGN PATENT DOCUMENTS

CN 1928682 A 3/2007
CN 100363969 C 1/2008

(Continued)

OTHER PUBLICATIONS

English Translation of the International Search Report dated Aug. 12, 2019, issued in corresponding International Application No. PCT/CN2018/118006, filed Nov. 28, 2018, 2 pages.

(Continued)

*Primary Examiner* — Dong Hui Liang
(74) *Attorney, Agent, or Firm* — Hauptman Ham, LLP

(57) ABSTRACT

A display control apparatus includes a data driver, a timing controller, and a control circuit. The data driver a data output circuit that is configured to output data signals. The timing controller is configured to output data control signals that control the signal input of the data driver and include a frame start signal $V_{S1}$ and a conventional signal $V_{S2}$. The control circuit is electrically connected with the timing controller and the data output circuit (211), and is configured to input signals to the data output circuit according to the data control signals.

18 Claims, 5 Drawing Sheets

(58) Field of Classification Search
CPC ..... G09G 3/296; G09G 3/2927; G09G 2300/0426; G09G 2300/0447; G09G 2300/0876; G09G 2310/0205; G09G 2310/067; G09G 2310/066; G09G 2320/0219; G09G 2320/0223; G09G 2320/0233; G09G 2320/0228; G09G 2320/0257; G09G 2340/0435
See application file for complete search history.

(56) References Cited

U.S. PATENT DOCUMENTS

| | | | | |
|---|---|---|---|---|
| 2006/0038761 | A1* | 2/2006 | Shen | G09G 3/3659 345/92 |
| 2008/0309687 | A1* | 12/2008 | Choi | G09G 3/3648 345/698 |
| 2009/0267936 | A1* | 10/2009 | Kwon | G09G 3/325 345/213 |
| 2011/0279133 | A1* | 11/2011 | Harper | G01R 19/0092 324/691 |

FOREIGN PATENT DOCUMENTS

| | | | |
|---|---|---|---|
| CN | 101299324 | A | 11/2008 |
| CN | 101681606 | A | 3/2010 |
| CN | 102024438 | A | 4/2011 |
| CN | 103854620 | A | 6/2014 |
| CN | 104503632 | A | 4/2015 |
| CN | 104952407 | A | 9/2015 |
| CN | 105761690 | A | 7/2016 |
| CN | 107742502 | A | 2/2018 |
| CN | 107924658 | A | 4/2018 |
| CN | 107978263 | A | 5/2018 |
| CN | 108305590 | A | 7/2018 |
| CN | 108694909 | A | 10/2018 |
| JP | 2006072211 | A | 3/2006 |

OTHER PUBLICATIONS

Chinese Office Action dated Dec. 20, 2019, issued in corresponding CN Application No. 201811338831.4, filed Nov. 12, 2018, 8 pages.
Chinese Office Action dated Jul. 29, 2020, issued in corresponding CN Application No. 201811338831.4, filed Nov. 12, 2018, 9 pages.
Chinese Office Action dated Nov. 21, 2019, issued in CN Application No. 201811339280.3, filed Nov. 12, 2018, 13 pages.
Chinese Office Action dated Sep. 10, 2020, issued in CN Application No. 201811339280.3, filed Nov. 12, 2018, 17 pages.
Liao, Y.P., et al., "Thin film transistor liquid crystal display Theory and Design," Electronic Industry, Mar. 31, 2016, pp. 205-206 and pp. 225-226.

* cited by examiner

DISPLAY CONTROL APPARATUS AND DISPLAY DEVICE

TECHNICAL FIELD

This application relates to the field of display technologies, and in particular, to a display control apparatus and a display device.

BACKGROUND

The description herein provides only background information related to this application but does not necessarily constitute the existing technology.

With the development of display technologies, various display devices enrich people's production and living. Liquid crystal display technologies have been quite mature and are updated and improved continuously. Liquid crystal display devices occupy an absolute market position, and are widely applied to the fields of displays, computers, televisions, mobile phone screens, and the like.

In the related art, to avoid polarization of liquid crystal, an alternating current is used for driving the display device. That is, in a previous frame, a first polarity (for example, a positive polarity) voltage is used for driving, and in a next frame, a second polarity (for example, a negative polarity) voltage is used for driving. In this case, a first row of sub-pixels in the next frame are often darker because the subpixels are not fully charged.

SUMMARY

According to various embodiments of this application, a display control apparatus and a display device adapted to improve dark display of a first row of sub-pixels are provided.

A display control apparatus comprises:

a data driver, comprising a data output circuit, wherein the data output circuit is configured to output a data signal;

a timing controller, configured to output a data control signal, wherein the data control signal controls signal input of the data driver, the data control signal comprises a frame start signal and a normal signal, the frame start signal is located at a start position of a frame, and the normal signal is after the frame start signal in the same frame; and a control circuit, electrically connected to the timing controller and the data output circuit, and configured to input a signal to the data output circuit according to the data control signal, wherein when the data control signal is the frame start signal, the control circuit inputs a first current to the data output circuit according to the data control signal; or when the data control signal is the normal signal, the control circuit inputs a second current to the data output circuit according to the data control signal, and the first current is greater than the second current.

A display control apparatus comprises:

a scanning driver, configured to output a scanning signal;

a data driver, comprising a data output circuit, wherein the data output circuit is configured to output a data signal;

a timing controller, configured to output a data control signal, wherein the data control signal is an input signal of the scanning driver and controls signal input of the data driver; and the data control signal comprises a frame start signal and a normal signal, the frame start signal is located at a start position of a frame, the normal signal is after the frame start signal in the same frame, and a level of the frame start signal is higher than a level of the normal signal; and a control circuit, comprising an N-type field effect transistor, a first current source, a P-type field effect transistor, and a second current source, wherein a gate electrode of the N-type field effect transistor is electrically connected to the timing controller and receives the data control signal, a source electrode of the N-type field effect transistor is electrically connected to the first current source, and a drain electrode of the N-type field effect transistor is electrically connected to the data output circuit;

a gate electrode of the P-type field effect transistor is electrically connected to the timing controller and receives the data control signal, a source electrode of the P-type field effect transistor is electrically connected to the second current source, and a drain electrode of the P-type field effect transistor is electrically connected to the data output circuit; and a current output by the first current source is greater than a current output by the second current source.

A display device comprises a display control apparatus and a display panel, wherein the display control apparatus comprises:

a data driver, comprising a data output circuit, wherein the data output circuit is configured to output a data signal;

a timing controller, configured to output a data control signal, wherein the data control signal controls signal input of the data driver, the data control signal comprises a frame start signal and a normal signal, the frame start signal is located at a start position of a frame, and the normal signal is after the frame start signal in the same frame; and a control circuit, electrically connected to the timing controller and the data output circuit, and configured to input a signal to the data output circuit according to the data control signal, wherein when the data control signal is the frame start signal, the control circuit inputs a first current to the data output circuit according to the data control signal; or when the data control signal is the normal signal, the control circuit inputs a second current to the data output circuit according to the data control signal, and the first current is greater than the second current; and the display panel comprises a plurality of rows of sub-pixels and a plurality of data lines, and the data lines are electrically connected to the data output circuit and the sub-pixels.

Details of one or more embodiments of this application are provided in the following accompanying drawings and descriptions. Other features, objectives, and advantages of this application will become apparent from the specification, the accompanying drawings, and the claims.

DETAILED DESCRIPTION

To make the objectives, technical solutions, and advantages of this application clearer and more comprehensible, the following further describes this application in detail with reference to the accompanying drawings and embodiments. It should be understood that the specific embodiments described herein are merely used to explain this application but are not intended to limit this application.

A display control apparatus provided in this application may be, but not limited to being applied to liquid crystal display devices (for example, a liquid crystal computer, a liquid crystal television, a liquid crystal mobile phone screen, and the like).

Figure 1:
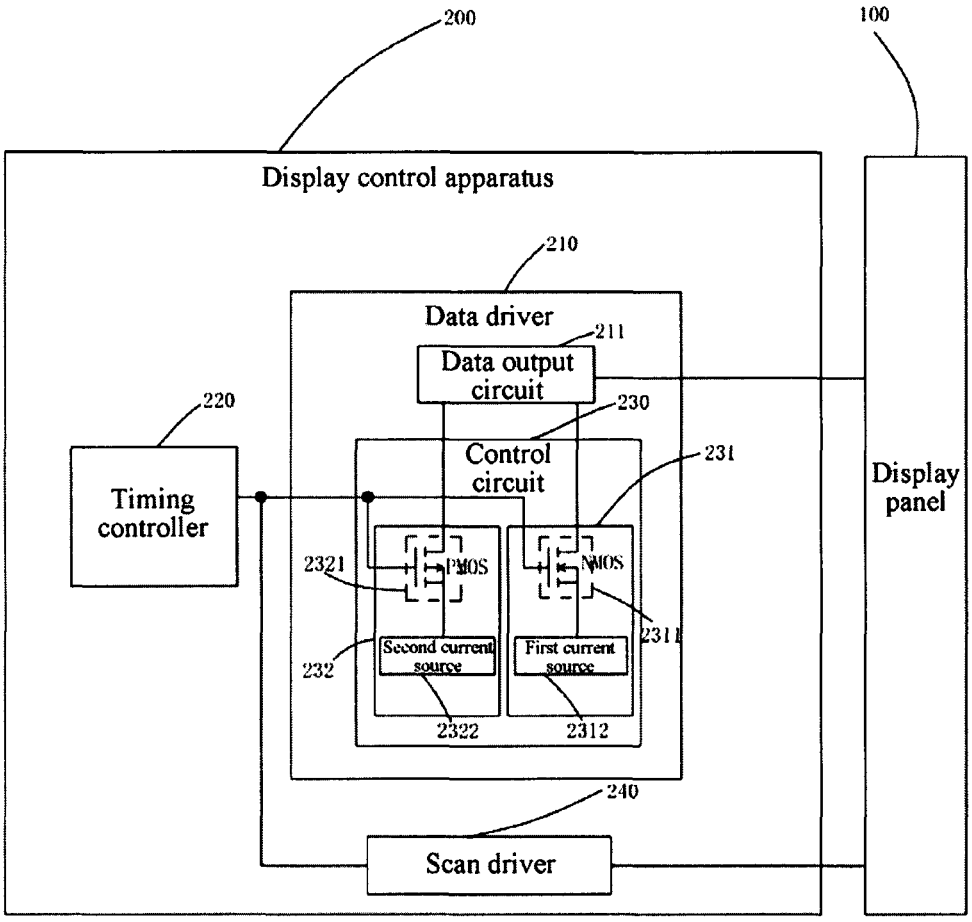
FIG. 1 is a schematic diagram of a display device according to an embodiment of this application.
Figure 2:
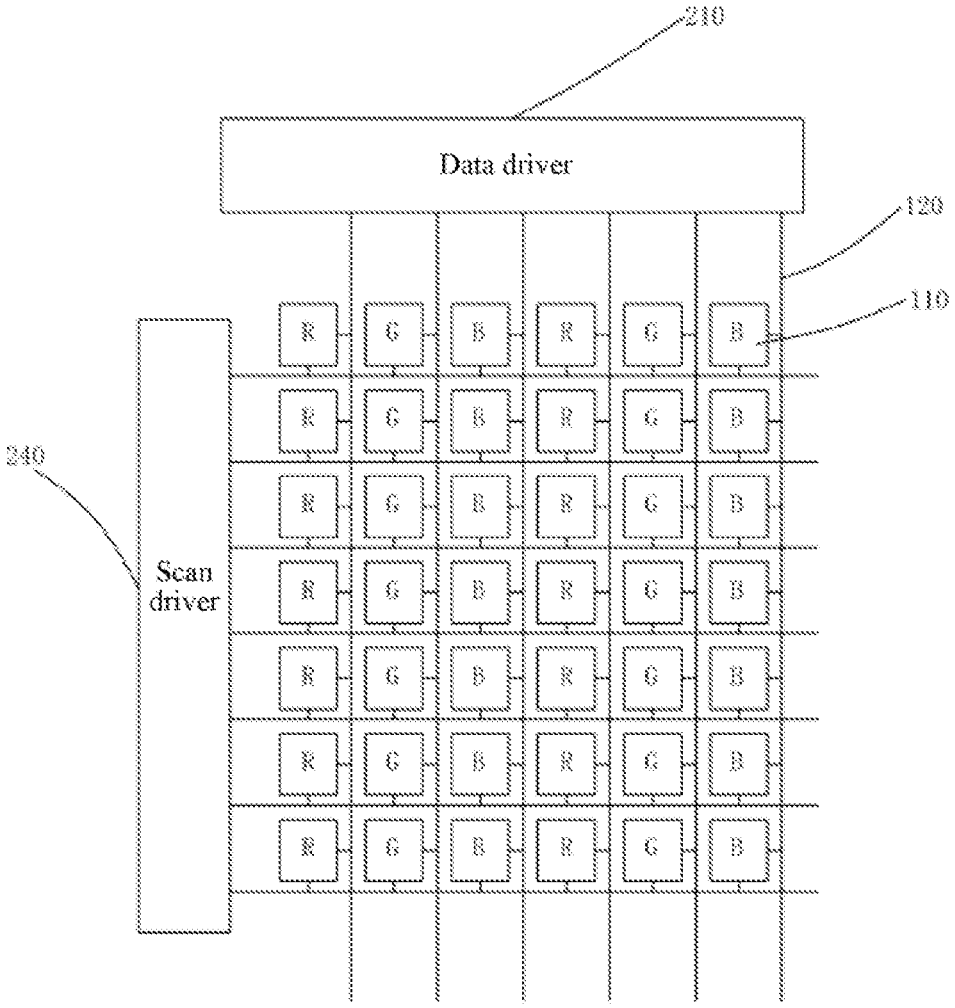
FIG. 2 is a schematic partial diagram of a display device according to an embodiment of this application.

Referring to FIG. 1 and FIG. 2, in an embodiment, a display device is provided. The display device includes a display panel 100 and a display control apparatus 200. The display panel 100 includes a plurality of rows of sub-pixels 110 and a plurality of data lines 120. The data lines 120 are electrically connected to the display control apparatus and the sub-pixels 110, to charge each row of sub-pixels 110.

Specifically, referring to FIG. 2, the display panel 100 may include a plurality of different colors of sub-pixels 110, for example, a red sub-pixel 110R, a green sub-pixel 110G, a blue sub-pixel 1101B, and the like. The plurality of different colors of sub-pixels 110 may form a display circuit. The different colors of sub-pixels 110 in the display circuit cooperate with each other, so that the display circuit may display any required color. In addition, all the sub-pixels 110 of the display panel are sequentially arranged in a plurality of rows, and in each row, there is a plurality of sub-pixels 110. When the display panel works, the sub-pixels 110 are switched on row by row. The sub-pixel 110 may include a pixel electrode, a common electrode, and liquid crystal molecules between the two electrodes. When each row of sub-pixels 110 is switched on, the data lines 120 charge a pixel electrode of each sub-pixel 110, so that liquid crystal molecules deflect and are translucently displayed.

The display control apparatus 200 is connected to the data lines 120, so as to provide data signals to charge the data lines 120. Referring to FIG. 1, the display control apparatus 200 specifically includes a data driver 210 and a timing controller 220.

The data driver 210 includes a data output circuit 211. The data output circuit 211 is configured to output data signals to the data lines 120. To avoid polarization of liquid crystal, the data signals are in a form of alternating currents. That is, when the display device works, polarities of the data signals output by the data output circuit 211 to a same data line 120 in a previous frame and a next frame are different. There is an idle time between the previous frame and the next frame. In the idle time, the data output circuit 211 does not output a data signal, and a level a of the last drive voltage across a drive line (a line that connects the data output circuit 211 and the data line 120) of the display device in the previous frame is maintained.

Figure 3:
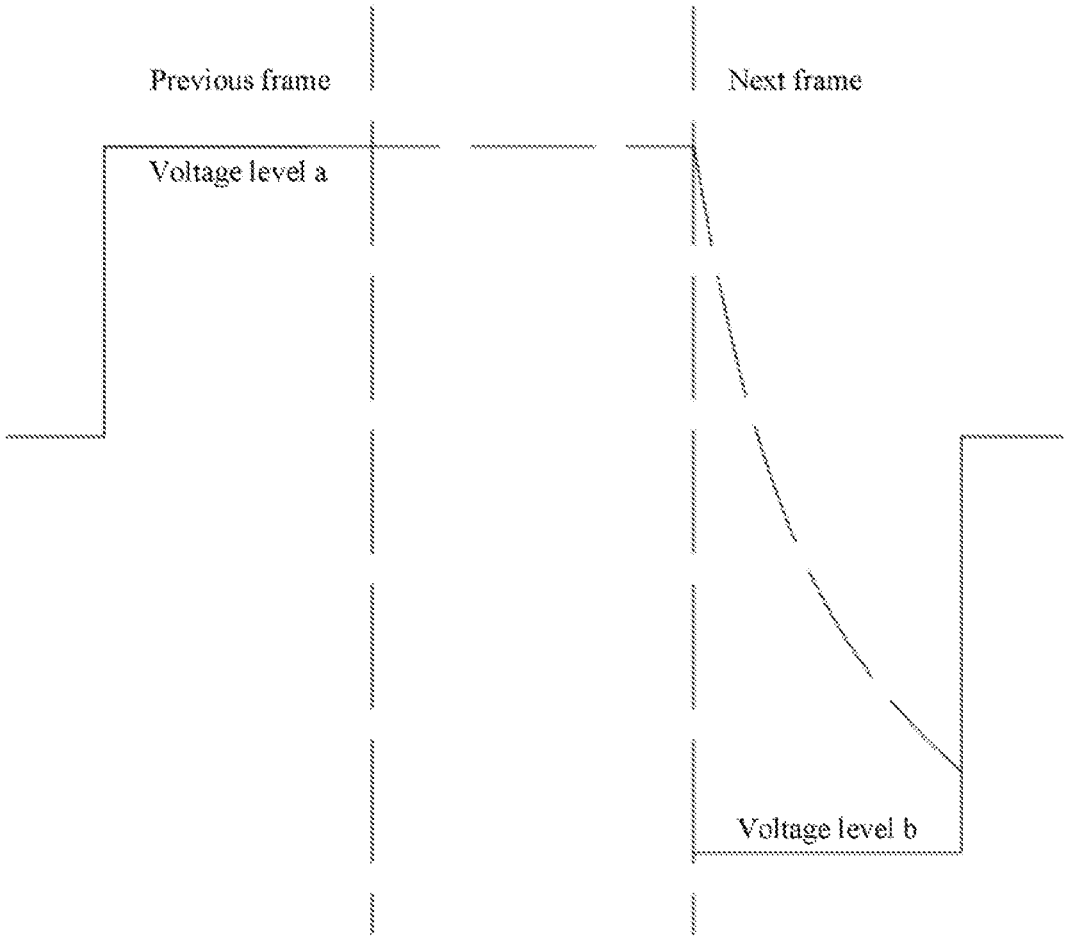
FIG. 3 is an example of a partial timing diagram of a data signal of a display device.

As shown in FIG. 3, in a display device as an example, when the data output circuit 211 outputs a data signal to a same data line 120 in the next frame, a voltage across the drive line starts to switch from the level a. It is assumed that a level of a target charging voltage to which the data line is switched is a level b that has a polarity opposite to that of the level a. Due to opposite polarities, there is a large difference between the voltage at the level a and the voltage at the level b, and consequently, a level of an actual charging voltage at which a first row of sub-pixels 110 start to be charged is easily lower than the level b of the target charging voltage. After the first row, when the data output circuit 211 charges other rows of sub-pixels 110 in the same frame, because a polarity of the data signal does not change, a level of an actual charging voltage of the other rows may easily reach the target charging voltage. Consequently, compared with the other rows of sub-pixels 110, the first row of sub-pixels 110 is relatively darker.

Figure 4:
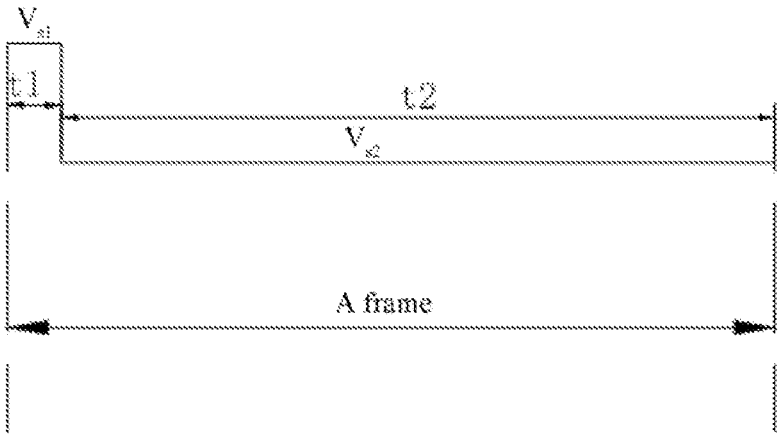
FIG. 4 is a timing diagram of a data control signal in a frame according to an embodiment of this application.

In this embodiment of this application, the timing controller 220 may output a data control signal. The data control signal controls signal input of the data driver 210. That is, an input signal of the data driver 100 is determined by the data control signal. The data control signal includes a frame start signal VS1. The frame start signal VS1 is located at a start position of a frame. When the timing controller 200 sends the frame start signal VS1, it indicates that a new frame starts. The data control signal further includes a normal signal VS2. Referring to FIG. 4, FIG. 4 is a timing diagram of a data control signal in a complete frame. The frame start signal VS1 is located at the start position of the frame and has duration tU. The normal signal VS2 is after the frame start signal in the same frame and has duration t2.

In addition, referring to FIG. 1, the display control apparatus in this embodiment of this application further includes a control circuit 230. The control circuit 230 is electrically connected to the timing controller 220, and then inputs a signal to the data output circuit 211 according to the data control signal. In addition, the control circuit 230 is electrically connected to the data output circuit 211, then inputs a signal to the data driver 210, and then further outputs, by using the data output circuit 211, a data signal positively correlated to an input signal received by the data output circuit 211.

When the data control signal is the frame start signal VS1, the control circuit 230 inputs a first current to the data output circuit 211 according to the data control signal. When the data control signal is the normal signal VS2, the control circuit inputs a second current to the data output circuit 211 according to the data control signal. The input second current is the same as the current input in the display device as an example, and the first current is greater than the second current.

Figure 5:
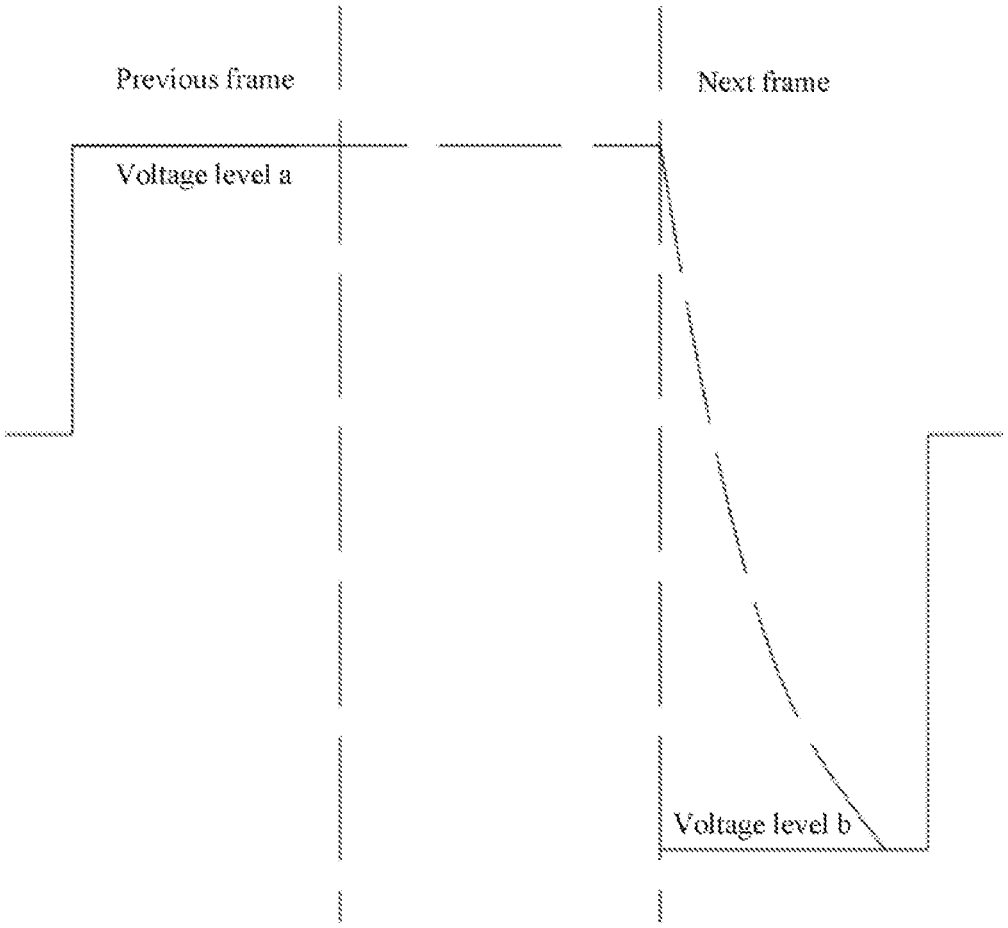
FIG. 5 is a partial timing diagram of a data signal according to an embodiment of this application.

Because the input signal received by the data output circuit 211 is positively correlated to the signal output by the data output circuit 211, when the data control signal is the frame start signal VS1 and the control circuit 230 inputs a relatively large first current to the data output circuit 211, a current output by the data output circuit 211 also increases. At the same time, as the current output by the data output circuit 211 increases, a charge transmission speed increases, and a switching speed of the data signal output by the data output circuit 211 also increases. Therefore, referring to FIG. 5, for the first row of sub-pixels 110 that is charged in a start phase of the next frame, because a switching speed of a voltage increases, the first row of sub-pixels 110 easily reaches an original position of the level of the target charging voltage in a shorter time. Therefore, a specified charging target is achieved, and a phenomenon that the first row of sub-pixels 110 is darker is further improved.

When the data control signal is the normal signal VS2, the control circuit 230 inputs a relatively small second current to the data output circuit 211. The input second current is the same as the current input in the display device as an example, and therefore, the second current can satisfy charging requirements of the other rows of sub-pixels 110 except the first row of sub-pixels 110. In this application, the relatively large first current and the relatively small second current are input in combination. That is, not only a case that the first row of the display device as an example is dark due to insufficient charging is improved, but also a current is reduced in time when the other rows are charged, thereby reducing energy consumption.

Referring to FIG. 1, in an embodiment, the control circuit 230 includes a first circuit 231 and a second circuit 232 that are connected in parallel. The first circuit 231 and the second circuit 232 in the control circuit 230 are separately disposed, so that different signals can be input to the data output circuit 211 according to different data control signals (the frame start signal VS1 and the normal signal VS2).

Specifically, when the data control signal is the frame start signal VS1, the first circuit 231 inputs the first current to the data output circuit 211 according to the data control signal, and the second circuit 232 is open. When the data control signal is the normal signal VS2, the second circuit 232 inputs the second current to the data output circuit 211 according to the data control signal, and the first circuit 231 is open.

In an embodiment, for the ease of implementing the foregoing functions of the first circuit 231 and the second circuit 232, the first circuit 231 is configured to include a first switch device 2311 and a first current source 2312 that are electrically connected to each other. The second circuit 232 includes a second switch device 2321 and a second current source 2322 that are electrically connected to each other.

Moreover, the first switch device 2311 is electrically connected to the timing controller 220 and the data output circuit 211. In addition, the second switch device 2321 is also electrically connected to the timing controller 220 and the data output circuit 211. The first current source 2312 is configured to output the first current, and the second current source 2322 is configured to output the second current.

When the data control signal is the frame start signal VS1, the first switch device 2311 is switched on, the second switch device 2321 is switched off, and the first current source 2312 inputs the first current to the data output circuit 211. When the data control signal is the normal signal VS2, the second switch device 2321 is switched on, the first switch device 2311 is switched off, and the second current source 2322 inputs the second current to the data output circuit 211.

Both the first switch device 2311 and the second switch device 2321 need to be electrically connected to three parts, and therefore, both the two devices may be set to be tri-terminal switch devices (for example, a transistor or a switch triode). For the ease of circuit design, both the two devices may be set to be switch devices of a same type (such as transistors or switch triode of a same type). Certainly, the two devices may be switch devices of different types.

Specifically, the two devices may be field effect transistors of two different conductive types. The first switch device 2311 may be a first-type (for example, an N-type or a P-type) field effect transistor. The second switch device 2321 may be a second-type (for example, a P-type or an N-type) field effect transistor. Certainly, this application is not limited thereto. Alternatively, the first switch device 2311 and the second switch device 2321 may be switch triodes or the like.

A gate electrode of the first-type field effect transistor and a gate electrode of the second-type field effect transistor are electrically connected to the timing controller 220 and receive the data control signal. A source electrode of the first-type field effect transistor is electrically connected to the first current source 2312, and a source electrode of the second-type field effect transistor is electrically connected to the second current source 2322. A drain electrode of the first-type field effect transistor and a drain electrode of the second-type field effect transistor are electrically connected to the data output circuit 211.

Both the first current source 2312 and the second current source 2322 are constant current sources. Therefore, the control circuit can provide a stable current for the data output circuit 211 of the data driver 210, so as to further ensure stable data signals output by the data output circuit 211.

In an embodiment, referring to FIG. 4, the duration t1 of the frame start signal VS1 is less than the duration t2 of the normal signal VS2. Because the frame start signal VS1 determines whether a compensation circuit 232 outputs a compensation signal, and duration required for outputting the compensation signal is generally close to duration of a row of scanning signals and far less than duration of a frame, a setting that t1 is less than t2 more satisfies requirements on this aspect comparatively.

In this case, it is set that a level of the normal signal VS2 is lower than a level of the frame start signal VS1, so that when the display control apparatus works, more energy consumption is reduced.

Certainly, in this application, the duration of the frame start signal VS1 is not limited. The duration of the frame start signal VS1 may be equal to charging duration of the first row of sub-pixels 110, may be less than the charging duration of the first row of sub-pixels 110, or may be greater than the charging duration of the first row of sub-pixels 110. It may be set that the duration of the frame start signal VS1 is less than the duration of the normal signal VS2, or may be set that the duration of the frame start signal VS1 is greater than the duration of the normal signal VS2. The level of the normal signal VS2 may be higher than the level of the frame start signal VS1.

In an embodiment, the display control apparatus 200 further includes a scanning driver 240 configured to output a scanning signal. The data control signal (the frame start signal VS1 and the normal signal VS2) is an input signal of the scanning driver 240. A level of an input signal received by the scanning driver 240 at a start position of a frame is comparatively higher than a level of an input signal received at a later time point in the same frame, so that the foregoing condition setting of the frame start signal VS1 and the normal signal VS2 is satisfied. Therefore, the data control signal (the frame start signal VS1 and the normal signal VS2) may be set to be the input signal of the scanning driver 240, so that the input signal of the scanning driver 240 of the display control apparatus is multifunctional, and an output circuit structure of the display control apparatus 200 is simplified, thereby reducing energy consumption of the display control apparatus.

Certainly, in this embodiment of this application, the data control signal (the frame start signal VS1 and the normal signal VS2) may not be the input signal of the scanning driver 240 and is otherwise designed. This is not limited in this application.

In an embodiment, still referring to FIG. 4, t1 is scanning duration of the first row of sub-pixels in a frame, and t2 is a sum of scanning duration of the second row of sub-pixels and the other rows of sub-pixels following the second row. t1 is the scanning duration of the first row of sub-pixels in the frame. In other words, the duration t1 of the frame start signal VS1 at a high level is equal to duration of a row of scanning signals of the scanning driver, and is also equal to the charging duration of the first row of sub-pixels 110. Therefore, it can be ensured that the first row of sub-pixels 110 can have a sufficiently fast voltage switching speed in the whole scanning duration of the row, so as to be fully charged. In addition, high level signals are not wasted in the second row of sub-pixels and the other rows of sub-pixels 110 following the second row that are originally fully charged, thereby reducing energy consumption.

In an embodiment, the data output circuit 211 includes an operation amplifier and a data output end, the control circuit is electrically connected to the operation amplifier, and the operation amplifier is located between the control circuit and the data output end. Therefore, the data output circuit 211 may effectively amplify, by using the operation amplifier, an input signal received by the data output circuit 211, to form an amplified data signal for outputting.

In an embodiment, the control circuit 230 is located in the data driver 210, so as to conveniently input a signal to the data output circuit 211 of the data driver 210. Certainly, in this embodiment of this application, the position of the control circuit 230 is not limited thereto, and may be other positions. For example, the control circuit 230 is located in the timing controller or the scanning driver 240.

In an embodiment, as shown in FIG. 1, a display control apparatus 200 includes a scanning driver 240, a data driver 210, and a timing controller 220. The scanning driver 240 is configured to output a scanning signal. The data driver 210 includes a data output circuit 211. The data output circuit 211 is configured to output a data signal. The timing controller 220 is configured to output a data control signal. The data control signal is an input signal of the scanning driver 240 and controls signal input of the data driver 210, to implement multifunction of the data control signal. The data control signal includes a frame start signal VS1 and a normal signal VS2. The frame start signal VS1 is located at a start position of a frame, and the normal signal VS2 is after the frame start signal in the same frame. A level of the frame start signal VS1 is higher than a level of the normal signal VS2.

The display control apparatus further includes a control circuit 230. The control circuit 230 may be located in the data driver 210, and certainly, may be located elsewhere. The control circuit 230 includes an N-type field effect transistor, a first current source 2312, a P-type field effect transistor, and a second current source 2322. When the data control signal is the frame start signal VS1 at a high level, the N-type field effect transistor is switched on, and the P-type field effect transistor is switched off. When the data control signal is the normal signal VS2 at a low level, the N-type field effect transistor is switched off, and the P-type field effect transistor is switched on.

A gate electrode of the N-type field effect transistor is electrically connected to the timing controller 220 and receives the data control signal, a source electrode of the N-type field effect transistor is electrically connected to the first current source 2312, and a drain electrode of the N-type field effect transistor is electrically connected to the data output circuit 211. Therefore, when the data control signal is the frame start signal VS1 at a high level, the N-type field effect transistor inputs a relatively large current to the data output circuit 211 to increase a switching speed of a voltage output by the data output circuit 211, so that the first row of sub-pixels 110 is fully charged, and a phenomenon that the first row of sub-pixels 110 is darker is improved.

What is claimed is:

1. A display control apparatus, comprising:

a data driver comprising a data output circuit, wherein the data output circuit is configured to output a data signal;

a timing controller configured to output a data control signal, wherein the data control signal controls signal input of the data driver, the data control signal comprises a frame start signal and a normal signal, the frame start signal is located at a start position of a frame, and the normal signal is after the frame start signal in the same frame; and a control circuit electrically connected to the timing controller and the data output circuit, and configured to input a signal to the data output circuit according to the data control signal, wherein when the data control signal is the frame start signal, the control circuit inputs a first current to the data output circuit according to the data control signal; or when the data control signal is the normal signal, the control circuit inputs a second current to the data output circuit according to the data control signal, and the first current is greater than the second current;

the control circuit comprises a first circuit and a second circuit connected in parallel;

when the data control signal is the frame start signal, the first circuit inputs the first current to the data output circuit according to the data control signal, and the second circuit is open; or when the data control signal is the normal signal, the second circuit inputs the second current to the data output circuit according to the data control signal, and the first circuit is open;

the first circuit comprises a first switch device and a first current source electrically connected to each other, and the second circuit comprises a second switch device and a second current source electrically connected to each other;

the first switch device is electrically connected to the timing controller and the data output circuit; and the second switch device is electrically connected to the timing controller and the data output circuit;

the first current source is configured to output the first current, and the second current source is configured to output the second current; and when the data control signal is the frame start signal, the first switch device is switched on, the second switch device is switched off, and the first current source inputs the first current to the data output circuit; or when the data control signal is the normal signal, the second switch device is switched on, the first switch device is switched off, and the second current source inputs the second current to the data output circuit.

2. The display control apparatus according to claim 1, wherein a duration of the frame start signal is less than a duration of the normal signal.

3. The display control apparatus according to claim 2, wherein a level of the normal signal is lower than a level of the frame start signal.

4. The display control apparatus according to claim 3, wherein the display control apparatus further comprises a scanning driver configured to output a scanning signal, and the data control signal is an input signal of the scanning driver.

5. The display control apparatus according to claim 4, wherein the duration of the frame start signal is the same as duration of a row of scanning signals of the scanning driver.

6. The display control apparatus according to claim 1, wherein both the first switch device and the second switch device are switch devices of a same type.

7. The display control apparatus according to claim 6, wherein the first switch device and the second switch device are field effect transistors of two different conductive types.

8. The display control apparatus according to claim 7, wherein the first switch device is an N-type field effect transistor, and the second switch device is a P-type field effect transistor.

9. The display control apparatus according to claim 7, wherein the first switch device is a P-type field effect transistor, and the second switch device is an N-type field effect transistor.

10. The display control apparatus according to claim 1, wherein both the first switch device and the second switch device are tri-terminal switch devices.

11. The display control apparatus according to claim 1, wherein a level of the normal signal is higher than a level of the frame start signal.

12. The display control apparatus according to claim 1, wherein a duration of the frame start signal is greater than a duration of the normal signal.

13. The display control apparatus according to claim 1, wherein the data output circuit comprises an operation amplifier and a data output end, the control circuit is electrically connected to the operation amplifier, and the operation amplifier is located between the control circuit and the data output end.

14. The display control apparatus according to claim 1, wherein the control circuit is located in the data driver.

15. The display control apparatus according to claim 1, wherein the control circuit is located in the timing controller.

16. The display control apparatus according to claim 1, wherein the display control apparatus further comprises a scanning driver configured to output a scanning signal, and the control circuit is located in the scanning driver.

17. A display control apparatus, comprising:

a scanning driver configured to output a scanning signal;

a data driver comprising a data output circuit, wherein the data output circuit is configured to output a data signal;

a timing controller configured to output a data control signal, wherein the data control signal is an input signal of the scanning driver and controls signal input of the data driver; and the data control signal comprises a frame start signal and a normal signal, the frame start signal is located at a start position of a frame, the normal signal is after the frame start signal in the same frame, and a level of the frame start signal is higher than a level of the normal signal; and a control circuit, comprising an N-type field effect transistor, a first current source, a P-type field effect transistor, and a second current source, wherein a gate electrode of the N-type field effect transistor is electrically connected to the timing controller and receives the data control signal, a source electrode of the N-type field effect transistor is electrically connected to the first current source, and a drain electrode of the N-type field effect transistor is electrically connected to the data output circuit;

a gate electrode of the P-type field effect transistor is electrically connected to the timing controller and receives the data control signal, a source electrode of the P-type field effect transistor is electrically connected to the second current source, and a drain electrode of the P-type field effect transistor is electrically connected to the data output circuit; and a current output by the first current source is greater than a current output by the second current source.

18. A display device, comprising a display control apparatus and a display panel, wherein the display control apparatus comprises:

a data driver comprising a data output circuit, wherein the data output circuit is configured to output a data signal;

a timing controller configured to output a data control signal, wherein the data control signal controls signal input of the data driver, the data control signal comprises a frame start signal and a normal signal, the frame start signal is located at a start position of a frame, and the normal signal is after the frame start signal in the same frame; and a control circuit electrically connected to the timing controller and the data output circuit, and configured to input a signal to the data output circuit according to the data control signal, wherein when the data control signal is the frame start signal, the control circuit inputs a first current to the data output circuit according to the data control signal; or when the data control signal is the normal signal, the control circuit inputs a second current to the data output circuit according to the data control signal, and the first current is greater than the second current;

the control circuit comprises a first circuit and a second circuit connected in parallel;

when the data control signal is the frame start signal, the first circuit inputs the first current to the data output circuit according to the data control signal, and the second circuit is open; or when the data control signal is the normal signal, the second circuit inputs the second current to the data output circuit according to the data control signal, and the first circuit is open;

the first circuit comprises a first switch device and a first current source electrically connected to each other, and the second circuit comprises a second switch device and a second current source electrically connected to each other;

the first switch device is electrically connected to the timing controller and the data output circuit; and the second switch device is electrically connected to the timing controller and the data output circuit;

the first current source is configured to output the first current, and the second current source is configured to output the second current;

when the data control signal is the frame start signal, the first switch device is switched on, the second switch device is switched off, and the first current source inputs the first current to the data output circuit; or when the data control signal is the normal signal, the second switch device is switched on, the first switch device is switched off, and the second current source inputs the second current to the data output circuit; and the display panel comprises a plurality of rows of sub-pixels and a plurality of data lines, and the data lines are electrically connected to the data output circuit and the sub-pixels.

* * * * *